US005387489A

United States Patent [19]

Fuller et al.

[11] Patent Number: 5,387,489

[45] Date of Patent: Feb. 7, 1995

[54] PROCESSES FOR THE PREPARATION OF DEVELOPER COMPOSITIONS

[75] Inventors: Timothy J. Fuller, W. Henrietta; James R. Larson, Fairport; Frank J. Bonsignore, Rochester, all of N.Y.

[73] Assignee: Xerox Corporation, Stamford, Conn.

[21] Appl. No.: 98,150

[22] Filed: Jul. 28, 1993

[51] Int. Cl.[6] ..... G03G 9/135

[52] U.S. Cl. ..... 430/115; 430/137

[58] Field of Search ..... 430/137, 106, 111, 115

[56] References Cited

U.S. PATENT DOCUMENTS 4,783,389 11/1988 Trout et al. ..... 430/137
4,917,986 4/1990 Chan et al. ..... 430/115
4,960,667 10/1990 Wong et al. ..... 430/114
5,053,306 10/1991 El-Sayed et al. ..... 430/137
5,123,962 6/1992 Komuro et al. ..... 106/163.1
5,168,022 12/1992 Wasmund et al. ..... 430/58
5,262,268 11/1993 Bertrand et al. ..... 430/137

*Primary Examiner*—John Goodrow
*Attorney, Agent, or Firm*—John L. Haack

[57] ABSTRACT

Disclosed is a process for preparing a liquid or dry electrophotographic developer comprising: (a) forming a melt mixture comprised of a polymer resin or resins, a colorant, a charge director, and a nonaqueous solvent to obtain a first suspension of colored polymeric particles with a volume average diameter of from about 5 to about 100 microns; and (b) homogenizing with a dairy piston homogenizer said first suspension under pressure of from about 100 to about 500 Bars to obtain a second suspension containing colored polymeric particles with a volume average diameter of from about 0.1 to about 5 microns.

22 Claims, No Drawings

PROCESSES FOR THE PREPARATION OF DEVELOPER COMPOSITIONS

CROSS REFERENCE TO COPENDING APPLICATIONS

Reference is made to application U.S. Ser. No 07/812 082 (D/90515), filed Dec. 23, 1991, entitled "Bead Suspension Polymerization Process" and U.S. Ser. No. 07/065,414 (D/92560), filed May 24, 1993, entitled "Liquid Developer Compositions".

BACKGROUND OF THE INVENTION

This invention is generally directed to processes for the preparation of liquid and dry toners, and more specifically to processes for the preparation of developer compositions containing small polymeric particles, for example, in embodiments with an average diameter of from about about 0.1 micron to about 5 microns. More specifically, the present invention is directed to economic processes for the preparation of micron and submicron size polymeric particles, useful as liquid and dry electrophotographic developer compositions, wherein a polymer resin or resins, a colorant or pigment, a charge director, and a nonaqueous solvent in admixture are, optionally dispersed with high shear or attrition to form finely dispersed particles, optionally heated to provide a melt mixture, to form a first suspension of colored polymeric particles with a volume average diameter of from about 5 to about 100 microns; optionally cooling the mixture to about 25° C.; optionally thermally cycling or shocking the mixture; homogenizing the first suspension with a dairy or milk piston homogenizer under pressure of about 100 to less than about 500 Bars, and preferably about 350 Bar, to obtain a second suspension of colored polymeric particles with a volume average diameter of from about 0.1 to about 5 microns; and optionally isolating the finely divided polymeric particles, for example. As indicated herein, the finely divided polymer particles obtained with the process of the present invention can, for example, be selected as liquid and dry electrophotographic developer compositions.

The formation of small polymeric particles for use in liquid and dry electrophotographic developer compositions by particle size reduction or comminution of larger particles has been generally accomplished by, for example, milling or grinding processes for extended periods of time wherein polymer particles suspended in a non-dissolving liquid are milled with optional heating to form particles having reduced particle size properties. With these processes, it has been difficult to achieve low cost, clean, that is for example with no, or substantially no, impurities from the milling media or apparatus on the surface of the resulting particles, and/or dry particles of small particle size. The particles formed by milling or grinding processes are generally larger than 2.0 micrometers thus they are not suitable as liquid and dry electrophotographic developer compositions, particularly for high quality color printing applications unless lengthy attrition times, generally exceeding 6 hours, are used to obtain particles on the order of 2 microns volume average diameter. Thus grinding or attrition, especially fluid energy milling, of large particles to the size needed for liquid and dry developer compositions, that is for example from about 0.1 to about 5 microns volume average diameter, is often not desirable both from an economic and functional viewpoint. Further, processes such as spray drying of polymers suspended in solvent can result in polymer particles with particle sizes much larger than about one micron and possessing a broad size distribution range including fibers and strands of filamented resins, as well as trapping of solvent which interferes with the viability of the particles as developers. Moreover, solvent recovery in these processes is very costly.

Trout et al, in U.S. Pat. No. 4,783,389, issued Nov. 8, 1983 disclose a process for the preparation of toner particles for liquid electrostatic imaging comprising: (a) mixing a thermoplastic resin and a nonpolar liquid at a temperature sufficient to plasticize and liquify the resin and below that at which the non-polar liquid boils and the resin decomposes; (b) cooling the mixture to form resin particles in the nonpolar liquid; and (c) reducing the size of the resin particles to below about 30 micrometers by passing the product of step (b) through at least one liquid jet interaction chamber at a liquid pressure of at least 1,000 psi (68 Bars), for example, using a Microfluidizer ® from Microfluidics. The process produces liquid electrostatic developer more rapidly than other known processes, the developer being useful in copying, making proofs, including digital proofs, and the like. The Microfluidizer ® method suffers from several disadvantages including frequent and recurring jet nozzle clogging with particles greater than 50 microns in diameter. Moreover, resin filaments and large particles are formed at operating pressures of greater than about 500 Bars. Thus at typical Microfluidizer ® processing pressures recommended by Trout et al, polymer suspensions in nonaqueous solvents tend to destabilize and lead to agglomerated particles that are not suitable for liquid or dry electrophotographic developers.

Komuro et al, in U.S. Pat. No. 5,123,962, issued Jun. 23, 1992 disclose a suspension comprising a dispersing medium containing at least 2% by weight of a fine particle cellulose material having a 50% cumulative volume diameter of from 0.3 to 6.0 micrometers. The suspension is obtained by a process comprising subjecting a cellulosic material to a depolymerization pretreatment, followed by wet grinding in a container containing a grinding medium and equipped with a rotary blade for forced stirring of the medium. The suspension has excellent viscosity, water retention properties, stability, and palatability.

El-Sayed et al, i n U.S. Pat. No. 5,053,306, issued Oct. 1, 1991 disclose a process for the preparation of toner particles for electrostatic liquid developers comprising: (a) dispersing at ambient temperatures a colorant, an A-B diblock copolymer grinding aid, and a carrier liquid; (b) adding to the dispersion a thermoplastic resin and dispersing at an elevated temperature to plasticize and liquify the resin; (c) cooling the dispersion while grinding with particulate media; (d) separating a dispersion of toner particles having an average by area particle size less than 10 micrometers, from the particulate grinding media; and (e) adding during or subsequent to step (b) at least one ionic or zwitterionic charge director compound. Steps (a) and (b) can be combined by adding the thermoplastic resin to the other ingredients and dispersing at an elevated temperature. The liquid developer can be prepared more quickly by the process than by other known processes. The liquid developers are useful in copying, in making color proofs, and the like.

Wasmund et al, in U.S. Pat. No. 5,168,022, issued Dec. 1, 1992 disclose a process for preparing a photoconductive pigment having a small particle size, a polymorph of a pigment is produced by a conversion process wherein a seed amount of the desired polymorph of the pigment and a larger amount of another polymorph of the pigment are subjected to a liquid jet interaction process.

Wong et al, in U.S. Pat. No. 4,960,667, issued Oct. 2, 1992 disclose a positively charged liquid developer composition comprised of resin particles, a hydrocarbon, laked carbon black particles, and a charge director wherein the composition is prepared in a shot mill attritor with steel balls.

Chan et al, in U.S. Pat. No. 4,917,986, issued Apr. 17, 1990 disclose a positive, liquid electrostatic developer consisting essentially of (a) a nonpolar liquid having a Kauri-butanol value of less than 30, present in a major amount, (b) thermoplastic resin particles having dispersed therein a phosphorous containing compound defined therein which is substantially insoluble or immiscible in the nonpolar liquid at ambient temperatures, the resin particles having an average by area particle size of less than 10 microns, and (c) a nonpolar liquid soluble ionic or zwitterionic charge director compound, and a process for preparation. The preparation process comprises (a) dispersing the resin, the phosphorous compound at elevated temperature, (b) cooling with or without stirring or while grinding, (c) separating the dispersion of toner particles from the particulate media, and (d) adding to the dispersion during or subsequent to step (a) a nonpolar liquid soluble ionic or zwitterionic charge director compound.

Also, suspension polymerization of monomers are known, for example, as disclosed in the aforementioned copending application U.S. Ser. No. 07/812,082 (D/90515)for the formation of polymer particles generally in a size range of about 200 microns and higher. The main advantage of suspension polymerization is that the product may easily be recovered, therefore, such a process is considered economical. However, it is very difficult by suspension polymerization to prepare very small, pigmented particles as the monomer droplets tend to coalesce during the polymerization process, especially in the initial stage of polymerization where the droplets are very sticky. For example, there is disclosed in U.S. Pat. No. 3,243,419 a method of suspension polymerization wherein a suspending agent is generated during the suspension polymerization to aid in the coalescence of the particles. Also disclosed in U.S. Pat. No. 4,071,670 is a method of suspension polymerization wherein the monomer initiator mixture is dispersed in water containing stabilizer by a high shear homogenizer, followed by polymerization of suspended monomer droplets.

Other references of interest include: U.S. Pat. Nos. 4,486,559, which discloses the incorporation of a prepolymer into a monomer toner mix followed by emulsion polymerization; 4,680,200 and 4,702,988, which illustrate emulsion polymerization.

The aforementioned Trout et al, U.S. Pat. No. 4,783,389, which utilizes a Microfluidizer® device to achieve particle size reduction relies upon two principle mechanisms: particle-particle collisions between opposing liquid streams and cavitation. Using a Microfluidizer® device for the preparation of liquid dispersions of very fine particles has several inherent complications and operational limitations, including, for example: 1) a requirement that the feed solution to be fluidized be hot, at a temperature of about 80° to about 100° C., and the initial particle size be less than about 50 micrometers; 2) the Microfluidizer® device is energy intensive requiring an air compressor to attain supersonic high pressures; 3) the device is operationally man power intensive in that it has various valving and orifices which readily clog and require regular dissembly and tedious cleaning thereby limiting potential for continuous operation; and 4) the device produces liquid ink developer formulations that tend to be unstable and have limited storage shelf-life in that the formulations may undergo catastrophic formulation failure on standing at room temperature as manifested by a congealing of the suspended resin particles into large monolithic solid masses which are difficult or nearly impossible to redisperse without resorting to high energy means. Moreover, resin filaments and large particles are formed at operating pressures greater than 500 Bars, typical Microfluidizer® processing/operating pressures.

Use of the aforementioned shot mill attritor technique for achieving resin in hydrocarbon formulation dispersion and particle size reduction of less than about 10 microns average diameter as, for example, in Wong U.S. Pat. No 4,960,667, typically a very energy and time intensive process and noisy unit operation, results in metal contamination from the steel balls which may require an additional magnetic filtration step. The shot mill has a rather limited operational void volume where the formula is processed even for very large attritors thus prohibiting rapid and continuous large scale production.

There thus remains a need for an economic and convenient process of obtaining very small polymeric particles, and more specifically micron and submicron polymeric particles, without the complications and disadvantages of the aforementioned prior art devices and processes. Further, there is a need for particle size reduction or comminution processes for obtaining clean, optionally dry and small polymeric particles, for example, from about 0.1 to about 5 microns in volume average diameter as determined by a scanning electron microscope or Malvern System 3601 particle size analyzer. Still further, there is a need for particle size reduction processes that permit low cost, clean, and optionally dry micron and submicron polymeric particles that can be selected as liquid and dry electrophotographic developer compositions, carrier powder coatings, photoconductor pigment-resin coating suspensions, and as toner additives for enhanced photoreceptor cleaning.

SUMMARY OF THE INVENTION

It is, therefore, an object of this invention to provide processes for preparing finely divided polymeric particles with many of the advantages illustrated herein.

In another object of the present invention there are provided simple processes for the formation of small polymeric particles, and mope specifically submicron size polymeric particles.

Yet, in another object of the present invention there are provided simple and economical processes for the formation of finely divided polymeric particles, and more specifically submicron size polymeric particles.

Another object of the present invention resides in the provision of simple and economical processes for the preparation of low cost, clean, that is substantially no impurities, and well defined size distribution polymeric particles, especially polymeric particles for liquid and dry electrophotographic developer compositions.

Another object of the present invention resides in simple and economical homogenization processes for the preparation of low cost, clean, and well defined particle size distribution small polymeric particles, and more specifically submicron size polymeric particles useful for liquid or dry electrophotographic developers.

Further, another object of the present invention resides in simple and economical processes for producing a low cost, clean and well defined particle size distribution of polymeric particles especially polymeric particles useful as toner additives and photoreceptor additives.

Additionally, in another object of the present invention there are provided, as a result of the enhanced degree of control and flexibility, processes for the preparation of finely divided polymeric particles with improved flow and fusing properties.

These and other objects of the present invention are accomplished by the provision of processes for the preparation of polymer particles, referred to herein as dispersion-homogenization processes which a mixture of a polymer resin or resins, a colorant or pigment, a charge director such as a fatty acid or fatty acid salt, and a non aqueous solvent are dispersed, optionally with high shear, optionally heated to provide a melt mixture, thereby forming a first suspension of polymeric particles with a volume average diameter of from about 5 to about 100 microns; optionally cooling the mixture to about 25° C.; optionally thermally cycling or shocking the mixture just prior to an homogenization step by heating the mixture from about 25° C. to about 100° C. and then rapidly cooling within 10 minutes to 25° C.; homogenizing with a dairy homogenizer available from for example, Nori-Soavi, the mixture under pressure to obtain a second suspension of polymeric particles with a volume average diameter of from about 0.1 to about 5 microns; and optionally isolating the finely divided polymeric particles.

One important specific embodiment of the present invention comprises the preparation of polymeric particles, which comprises the homogenization of thermoplastic polymers, a colorant or pigment, and charge control adjuvent or director in hydrocarbon medium to a achieve uniform particle size reduction rendering the resulting formulation suitable for use as a liquid developer. Alternatively, the liquid hydrocarbon medium may be removed to provide colored polymeric particles suitable for use as a dry developer.

Another specific embodiment of the present invention comprises a process for preparing liquid ink formulations which is achieved by, for example, combining NUCREL 599 (200 grams), a hot melt adhesive compound available from DuPont, 20 weight percent PV Fast Blue pigment, 3 weight percent WITCO 22, an aluminum stearate charge director available from Witco Chemical and NORPAR 15, a liquid hydrocarbon available from Exxon (95 weight percent based on the weight of solids) to a Union Process 1S (1 gallon capacity) shot mill attritor equipped with ⅜-inch steel shot. The mixture is stirred at 300 rpm while being externally heated with steam to 212° F. for 15 minutes. Steam heating is then discontinued and ambient temperature stirring is continued for 2 hours while the mixture reaches 100° F. The crude ink mixture as a suspension is then cooled externally with water coolant and stirring continued for 15 minutes. The resultant ink is sieved to remove the steel shot. The shot is rinsed with NORPAR 15 and combined with the filtrate. The resultant cyan colored particles in suspension at 7 weight percent solids is used as a feed fluid for a piston dairy homogenizer examples at pressures of: 100, 350, 500, 700, 1000 and 1200 Bars. In several examples, the feed ink suspension is heated to at least 80° C. (176° F.) and is then cooled with a water cooled condenser. Although not wanting to be limited by theory the chilled water cooling appears to shock the ink formulation in one or more of three ways: first, the ink rapidly crystallizes and particles precipitate; second, the suspension gels; and third the ink forms coatings on the sides of the water cooled condenser. The ink appears to be shear thickening and becomes unstable at homogenizer operating pressures greater than or equal to about 500 Bars. At process pressures less than 500 Bars, precipitated particles and gels are readily redispersed by the piston homogenizer. The feed suspension also appears to be unstable at temperatures greater than 120° F.

In an illustrative homogenization step, a Panda dairy piston homogenizer with an emulsion valve, is operated at 350 Bars with a feed temperature of 96° F. for 20 minutes using the above described cyan colored suspension feed fluid, which has previously been heated to 200° F. for three minutes followed by 8 minutes at 100° F. at 350 Bars process conditions, to obtain area average particles of 1.7 microns as determined using the Horiba CAPA-500, and volume average particles of 4.67 microns as determined using the Malvern System 3601. Other process conditions including embodiments described in the Examples can be used providing the objectives of the present invention are achieved.

Also, the process of the present invention is directed to the preparation of small polymeric particles, that is with, for example, a volume average particle diameter in the range of from about 0.1 micron to about 5 microns, for polymeric resins having a number ($M_n$) and weight ($M_w$) average molecular weight of from about 5,000 to about 500,000 and from about 10,000 to about 2,000,000, respectively, and preferably 30,000 to about 50,000 weight average molecular weight. A weight average to number average molecular weight ratio or polydispersity of polymer resins useful in the present invention is between 1 and 15.

Further, the process of the present invention is directed to the preparation of polymeric particles of volume average diameter of from about 0.1 to about 5.0 microns, and preferably near 2 microns, with a resin or resins having a number average molecular weight of from about 5,000 to about 50,000 and a weight average molecular weight of from about 10,000 to about 500,000 useful as liquid immersion development inks, carrier coatings, as photoreceptor additives, and as toner additives.

The polymeric resin or resins useful in the formulations of the present invention comprise from about 70 to about 98 percent by weight of the solids content of the developer.

Illustrative examples of polymers and copolymer resins present in an amount of, for example, from about 70 to about 98 weight percent of the solids phase in the composition include vinyl monomers consisting of ethylene or styrene and its derivatives such as styrene, α-methylstyrene, p-chlorostyrene, and the like; monocarboxylic acids and derivatives such as acrylic acid, methacrylic acid, methyl acrylate, ethyl acrylate, butyl acrylate, dodecyl acrylate, octyl acrylate, phenyl acrylate, methacrylic acids, methyl methacrylate, ethyl methacrylate, butyl methacrylate, octyl methacrylate, octadecyl methacrylate, acrylonitrile and acrylamide; dicarboxylic acids having a double bond and their derivatives such as maleic acid, monobutyl maleate, dibutylmaleate; vinyl esters such as vinyl chloride, vinyl acetate and vinyl benzoate; vinyl ketones such as vinyl methyl ketone and vinyl ether ketone; vinyl ethyl ether and vinyl isobutyl ether; vinyl naphthalene; unsaturated mono-olefins such as isobutylene and the like; vinylidene halides such as vinylidene chloride and the like; N-vinyl compounds such as N-vinyl pyrrole and the like; and mixtures thereof.

The colorant or pigment useful in the formulation of the present invention is present in an amount of, for example, from about 0.1 to about 30, and preferably 20, percent by weight of the solids content of the developer and is selected from the group consisting of cyan, yellow, magenta, red, green, blue, brown, orange and black pigments or dyes and mixtures thereof.

Illustrative examples of charge directors or charge adjuvants which are believed to function in controlling the sign and the magnitude of the charge on the suspended particles that are useful in the present invention include: fatty acids or fatty acid salts as a negative charge control agent and are selected from the group aluminum stearate and derivatives thereof, and aluminum t-butyl salicylate and mixtures thereof, and comprise from about 1 to about 15 percent by weight of the solids content of the developer. Among these compounds particularly useful and effective materials are aluminum stearate and block copolymers containing quaternary ammonium hydrogen halide salt side groups.

Nonaqueous solvent useful in the present invention as a solvent and developer suspending medium are branched or linear aliphatic hydrocarbons, for example, NORPAR 15 and ISOPAR L or H, and mixtures thereof, having from 10 to 25 carbon atoms and which solvent is present from about 50 to about 98 percent of the total weight of the developer.

In embodiments of the present invention the first formed melt mix suspension comprising resin, pigment or colorant, nonaqueous solvent, and charge director is optionally dispersed with high shear or ball milling to form suspended polymeric particles with a volume average diameter of from about 5 to about 100 microns. The suspended polymeric particles may be processed further by optionally thermally cycling or shocking the dispersion or suspension which is accomplished by rapidly heating the mixture from about 25° C. to about 100° C., then rapidly cooling to about 15° C. to about 40° C., wherein the cycle is accomplished over a period of about 1 minute to about 10 minutes.

The optional thermal cycling or shocking with rapid cold water cooling transforms the ink formulation in any of three ways: particles of the ink are rapidly precipitated; the suspension gels; and/or the ink formulation forms coatings on the sides of the water cooled condenser. All of the cycled or shocked mixtures are readily redispersed into small, about 2 micron, particles using the piston homogenizer provided operating pressures are less than 500 Bars and preferably between 100 and 350 Bars.

Homogenizing the dispersed mixture is accomplished with a dairy piston homogenizer which is commonly found in and used in the dairy industry, for example, a two stage homogenizer Model NS 1001L available from Niro-Soavi. The dairy piston homogenizer is comprised of a high pressure pump which is an electrically driven compression engine which in stage one compresses the fluid and particulates and in stage two impinges the mixture onto one of three different valves: an emulsion valve, a ball valve, or a cell-disruption valve. For particle size reduction described herein, either the emulsion or ball valve is most useful and preferred.

Using two step processing provides for mixing followed by subsequent particle size reduction in a single pass. However, one step piston homogenization processing also provides formulations which are useful and suitable as liquid and dry inks. In the one-step processing, the feed ink is passed directly through the piston homogenizer. In two-step processing comprising thermal processing followed by homogenization, the feed ink suspension is heated to about 80° C. and is then cooled using a cold, for example about 15° F., water condenser while being processed with the use of the piston homogenizer.

The particle size reduction apparatus used in the homogenization step of the present invention is known as a piston homogenizer device and comprises: (a) means for introducing the first suspension into the homogenizer and means for removing the resulting second suspension from the homogenizer; (b) a nozzle for ejecting the first suspension at high pressure; and (c) a flat plate or wall whereby collisions of the suspended particles contained in the suspending media under high pressure emanating from said nozzle results in ultra high shear forces and fractures the suspended polymeric particles further into the desired size domain and range of from about 0.1 micrometers to about 5 micrometers volume average diameter.

The pressure employed in the homogenization step is from about 100 Bars to less than about 500 Bars, and preferably of from about 100 to about 350 Bars. At pressures below the lower limit the particle size reduction is unsatisfactory and inefficient, and at pressures above about 350 Bars the dispersion appears to be destabilized and may lead to unacceptable and unmanageable shear thickening of the formulation.

The ink appears to shear thicken or is unstable at elevated pressures in excess or equal to about 500 Bars. At processing pressures less than about 500 Bar and typically between 100 to about 350 Bars, precipitated particles and gels were readily redispersed by the piston homogenizer. The feed suspension also appears to be unstable at temperatures greater than or equal to about 120° F.

Table 1 summarizes process conditions, such as time, pressure and temperatures used in representative examples of the present invention and comparative trials. Table 2 provides a summary of parameters and data obtained for formulations prepared by the present process and for Comparative Examples.

The pigmented polymeric particles obtained in embodiments have an area average particle diameter of from about 1.0 micron to about 2.5 microns as measured by, for example, an Horiba CAPA-500 centrifugation particle size analyzer, a volume average of particle diameter of from about 0.1 micron to about 5 micrometers as measured by, for example, the Malvern System 3601 and a geometric particle size distribution (GSD) of from about 1.2 to about 1.5.

The pigmented polymeric particles may be optionally isolated and subjected to washing and drying using known materials and methods when dry particles are desired. Isolation of the finely divided pigmented particles formed in the homogenization step can be achieved by any known separation technique such as filtration, centrifugation, and the like. Classical drying techniques such as vacuum drying, freeze drying, spray drying, fluid bed drying and the like can be selected for drying of the polymeric particles.

The finely divided polymeric particles prepared by processes of the present invention may be optionally treated with surface additives to enhance development properties and performance. The surface additives are comprised of fine powders of conductive metal oxides, metal salts, metal salts of fatty acids, colloidal silicas, titanates, quaternary ammonium salts, zwitterionic salts, metal complexes, organometallic complexes, or mixtures thereof.

Other surface additives having charge directing or control properties comprise a mixture of a colloidal silica or titanate, and an organoaluminum, organoboron, organozinc, organochromium complex of a salicylic acid or catechol.

Charge control additives for regulating the charging properties of the dispersed polymeric particles may be added to the surface of the dry polymeric particles by for example, roll or cone milling, or may be adsorbed to the surfaces of the liquid dispersed particles or dispersed in the liquid suspending medium.

Preferred charge control director additives in liquid developers of the present invention typically are inverse micelles used to facilitate particle charging and are comprised of quaternary ammonium salts which are often polymeric in nature, conductive metal oxides, metal and organometallic salt, and the like. Particularly preferred charge director compounds useful in the present invention are comprised of a protonated AB diblock copolymer selected from the group of poly[2-dimethylammonium ethyl methacrylate bromide co-2-ethylhexyl methacrylate], poly[2-dimethylammonium ethyl methacrylate tosylate co-2-ethylhexyl methacrylate], poly[2-dimethylammonium ethyl methacrylate chloride co-2-ethylhexyl methacrylate], poly[2-dimethylammonium ethyl methacrylate bromide co-2-ethylhexyl acrylate], poly[2dimethylammonium ethyl acrylate bromide co-2-ethylhexyl methacrylate], poly[2-dimethylammonium ethyl acrylate bromide co-2-ethylhexyl acrylate], poly[2-dimethylammonium ethyl methacrylate tosylate co-2-ethylhexyl acrylate], poly[2-dimethylammonium ethyl acrylate tosylate co-2-ethylhexyl acrylate], poly[2-dimethylammonium ethyl methacrylate chloride co-2-ethylhexyl acrylate], and poly[2-dimethylammonium ethyl acrylate chloride co-2-ethylhexyl acrylate], poly[2-dimethylammonium ethyl methacrylate bromide co-N,N-dibutyl methacrylamide], poly[2-dimethylammonium ethyl methacrylate tosylate co-N,N-dibutyl methacrylamide], poly[2-dimethylammonium ethyl methacrylate bromide co-N,N-dibutylacrylamide], poly[2-dimethylammonium ethyl methacrylate tosylate co-N,N-dibutylacrylamide], and the like, and mixtures thereof.

The following examples are being submitted to further define various species of the present invention. These examples are intended to be illustrative only and are not intended to limit the scope of the present invention. Also, parts and percentages are by weight unless otherwise indicated. Comparative examples are also provided.

EXAMPLE I

Liquid Immersion Development(LID) Ink Preparation Used as the Feed for the Dairy Piston Homogenizer. A mixture of NUCREL 599 (175 grams), 20 weight percent PV Fast Blue (45.4 grams), 3 weight percent WITCO 22 (aluminum stearate, 6.8 grams), and NORPAR 15 (2,800 grams) was added to a Union Process 1S one gallon shot mill attritor containing stainless steel shot (2,700 kilo-grams, 54,000 balls). The mixture was stirred at 200 rpms and externally heated with steam to about 200° F. Steam heating was discontinued and stirring was then continued for two hours until the internal temperature was 100° F. The mixture was cooled using external coolant water at 15° F. while stirring was continued for 15 minutes. The resultant mixture was sieve filtered to remove the steel shot. The shot was rinsed with additional small amounts of NORPAR 15 and the combined filtrates at 7 weight percent solids were used as the feed fluid for the piston homogenization step. The mixture consisted of particles in which more than 50% of the particles were 10.5 microns by volume as determined using the Malvern System 3601 and more than 50% of the particles were 2.8 microns by area as determined using the Horiba CAPA-500. This LID ink dispersion was used as the feed ink for evaluating the piston homogenizer, the Microfluidizer® in Comparative Example I, and the shot mill attritor in Comparative Example II.

EXAMPLE II

Two Stage Panda Piston Homogenizer. The following piston homogenizer process parameters were varied:

Process valves or stages—either the ceramic ball or the emulsion process valves were used.

Process pressure—the piston homogenizer was operated at pressures of 100, 350, 500, 700, 1000, and 1200 Bars, respectively, by the aforementioned one-step or two-step processes.

Process temperature—process temperatures between 80° and 180° F. were used. Process temperature is partly dependent on process pressures in that higher process pressures resulted in higher process temperatures. The following temperature ranges were observed with increased process pressures: 100 to 500 Bars, 80° to 100° F.; 700 to 1000 Bars, 96° to 136° F.; and 1200 Bars, 110° to 138° F.

Process time—samples were not removed with number of passes through the homogenizer, but rather, the feed was continuously recycled and monitored with time. At flow rates between 8 to 10 L per hour, a large number of passes were accomplished in short times with volumes of ink tested.

Two step processing involved as a first step steam heating followed by water cooling and then a second step comprising piston homogenization. The suspension typically congealed, crystallized and precipitated with two step processing upon cooling. High solids sediments formed on the coolant container walls and were especially prevalent at excess high pressures near or greater than 500 Bars. Gels, strands and particulate sediments were routinely observed to form at high pressures. These metastable samples were redispersed by changing the process conditions, usually by lowering the process pressures below 500 Bars and by increasing process times at temperatures less than 120° F. and preferably near 100° F.

EXAMPLE III

One-Step Processing of LID Ink Using the Piston Homogenizer and the Emulsion Valve. The process conditions used and the particle size analysis of the resultant dispersions are summarized in Table 1. Feed ink from Example I was passed through the Panda piston homogenizer at 1,400 psi (100 Bars) for 10 minutes using the emulsion valve and one stage processing. The temperature of the dispersion increased from 70° F. to 90° F. during the process. The resultant dispersion was comprised of more than 50% particles with average area less than 2.05 microns (Horiba) and more than 50% particles with average volume less than 4.97 microns. The resultant ink dispersion was charged with 40 milligrams of a hydrogen bromide quaternary ammonium polymeric charge director, poly[2-dimethylammonium ethyl methacrylate bromide co-2-ethylhexyl methacrylate], per gram of particle solids at 2 weight percent solids in NORPAR 15. An ESA (MATEC-MBS-8000 and SC-90) particle mobility of $-1.49\times10^{-10}m^2A/.$-sec, a Zeta potential of −115.1 mV and a conductivity of 13 picomhos were measured.

The process of Example I was repeated with the exceptions that the feed ink from Example I was passed through the Panda piston homogenizer at 1,400 psi (100 Bars) for 3 minutes using the emulsion valve and one stage processing. The temperature of the dispersion increased from 70° F. to 80° F. during the process. The resultant dispersion was comprised of more than 50% particles with average area less than 2.27 microns (Horiba) and more than 50% particles with average volume less than 5.41 microns (Malvern). The resultant ink dispersion was charged with 40 milligrams of the hydrogen bromide quaternary ammonium polymeric charge director of Example III per gram of particle solids at 2 weight percent solids in NORPAR 15. An ESA particle mobility of $-1.22\times10^{-10}m^2/V.sec$, a Zeta potential of −104.3 mV and a conductivity of 13 picomhos were measured. The particle size of the dispersion decreased with increasing processing time using the piston homogenizer.

EXAMPLE IV

One-Step Processing of LID Ink Using the Piston Homogenizer with Ceramic Ball Valve. The feed ink of EXAMPLE I was passed through the Panda piston homogenizer at 350 Bars (5,000 psi) for between 1 and 3 minutes using the ceramic ball valve and one stage processing. The temperature of the dispersion increased from 70° F. to 80° F. during the process. The resultant dispersion was comprised of more than 50% particles with average area less than 2.12 microns (Horiba) and more than 50% particles with average volume less than 5.32 microns. The resultant ink dispersion was charged with 40 milligrams of the HBr quaternary ammonium polymeric charge director of Example III per gram of particle solids at 2 weight percent solids in NORPAR 15. An ESA particle mobility of $-0.55\times10^{-10}m^2/V.sec$, a Zeta potential of −43.7 mV and a conductivity of 9 picomhos were measured.

EXAMPLE V

Two-Step Processing of LID Ink Using the Piston Homogenizer with Ceramic Ball Valve. The feed ink of EXAMPLE I was passed through the Panda piston homogenizer at 350 Bars (5,000 psi) for 20 minutes using the ceramic ball valve and one stage processing. The temperature of the dispersion was increased from 70° F. to 200° F. during the process for 3 minutes and then was cooled to 100° F. over 8 minutes. The coagulated suspension was processed for an additional 10 minutes at 350 Bars (5,000 psi) at 96° F. The resultant dispersion was comprised of more than 50% particles with average area less than 1.88 microns (Horiba) and more than 50% particles with average volume less than 6.19 microns (Malvern). The resultant ink dispersion was charged with 40 milligrams of the HBr quaternary ammonium polymeric charge director of Example III per gram of particle solids at 2 weight percent solids in Norpar 15. An ESA particle mobility of $-1.5\times10^{-10}m^2/V.sec$, a Zeta potential of −99.7 mV and a conductivity of 13 picomhos were measured. This charged ink produced photocopies with excellent print quality using the Savin 870 photocopier.

EXAMPLE VI

Two-Step Processing of LID Ink Using the Piston Homogenizer and the Emulsion Ball Valve. The feed ink of EXAMPLE I was passed through the Panda piston homogenizer at 350 Bars (5,000 psi) for 17 minutes using the emulsion valve and one stage processing. The temperature of the dispersion was increased from 70° F. to 200° F. during the process for 7 minutes and then was cooled to 92° F. over 10 minutes. The resultant dispersion was comprised of more than 50% particles with average area less than 2.07 microns (Horiba) and more than 50% particles with average volume less than 5.94 microns. The resultant ink dispersion was charged with 40 milligrams of the HBr quaternary ammonium polymeric charge director of Example III, per gram of particle solids at 2 weight percent solids in NORPAR 15. An ESA particle mobility of $-1.51\times10^{-10}m^2/V.sec$, a Zeta Potential of −116.2 mV and a conductivity of 14 picomhos were measured

EXAMPLE VII

Two-Step Processing of LID Ink Using the Piston Homogenizer and the Emulsion Ball Valve. The feed ink of EXAMPLE I was passed through the Panda piston homogenizer at 100 Bars (1,430 psi) for 30 minutes using the emulsion valve and one stage processing. The temperature of the dispersion was increased from 70° F. to 200° F. during the process for 10 minutes and then was cooled to 86° F. over 20 minutes. The resultant dispersion was comprised of more than 50% particles with average area less than 2.06 microns (Horiba) and more than 50% particles with average volume less than 5.69 microns. The resultant ink dispersion was charged with 40 milligrams of the HBr quaternary ammonium polymeric charge director of Example III per gram of particle solids at 2 weight percent solids in NORPAR 15. An ESA particle mobility of $-1.12\times10^{-10}m^2/V.sec$, a Zeta Potential of −86.4 mV and a conductivity of 13 picomhos were measured.

COMPARATIVE EXAMPLE I

Microfluidizer ®. The feed ink of EXAMPLE I was passed through a Microfluidizer ® for 20 minutes at 500 Bars (7,100 psi). The resultant dispersion was comprised of more than 50% particles with average area diameter less than 3.5 microns (Horiba) and more than 50% particles with average volume diameter less than 23.5 microns. The particles obtained using the Microfluidizer ® were larger than those measured in the feed ink. The feed ink of Example I was passed through the Microfluidizer ® between 5 and 20 minutes process time and between 500 and 1,400 Bars process pressure. The resultant dispersions were comprised of more than 50% particles with average area diameters greater than 3.5 microns (Horiba). Table 2 provides a summary of parameters and data obtained for this Comparative Example and other Examples.

The piston homogenizer yielded 1.73 micron area particle size after 20 minutes at 350 Bars. By contrast the Microfluidizer® after 20 minutes at 500 Bars (the lowest pressure setting) yielded particles near 3.5 micron and the shot mill yielded 2 micron particles after 4 hours of cold grinding (6 hours total). Thus the piston homogenizer produced the smallest particles during the shortest process time. Excellent prints were obtained with the 1.7 micron ink prepared in the piston homogenizer (after 20 minutes at 350 Bars) using the Savin photocopier (Model 870) with NORPAR 15 carrier fluid.

COMPARATIVE EXAMPLE II

Union Process 01 Shot Mill Attritor. NUCREL 599 (20 grams), 3 weight percent WITCO 22, 20 weight percent PV Fast Blue, and NORPAR 15 (170 grams) were heated in a Union Process 01 attritor containing 2,400 gram stainless steel ⅜-inch shot until 200° F. was achieved. Heating was discontinued and ambient temperature stirring was maintained for 2 hours. Water cooling and stirring was then maintained for 4 more hours. The ink was then washed from the shot with 270 grams of NORPAR 15 using a strainer and the calculated percent solids of the resultant ink was 4.5%. The resultant dispersion was comprised of more than 50% particles with average area diameter less than 2.44 microns (Horiba) and more than 50% particles with average volume diameter less than 6.5 microns. The resultant ink dispersion was charged with 50 milligrams of the HBr quaternary ammonium polymeric charge director of Example III, per gram of particle solids at 2 weight percent solids in NORPAR 15. An ESA particle mobility of $-1.51\times10^{-10}m^2/V.sec$, a Zeta potential of $-110$ mV and a conductivity of 13 picomhos were measured.

The above mentioned patents and publications are incorporated by reference herein in their entirety.

Other embodiments and modifications of the present invention may occur to those skilled in the art subsequent to a review of the information presented herein; these embodiments and modifications, as well as equivalents thereof, are also included within the scope of this invention.

TABLE 1

Comparative Process Conditions (time, pressure and temperature) and Results.

| Processing Apparatus | Process time (hours) and temperature (°C.) | Malvern 50% volume particle size (microns) | Horiba particle area (microns) |
|---|---|---|---|
| Initial Feed Ink | 2h hot/0.25h ambient | 10.5 | 2.8 |
| Niro-Soavi piston homogenizer | 0.33h ambient | 4.6 | 1.73 |
| Micro-fluidizer® | 0.33h ambient | 23.5 | 3.5 |
| Shot mill attritor | 6h (2h hot/ 4h ambient) | 6.0 | 2.0 |

ambient = cool (0–25° C.) tap water coolant

TABLE 2

Conditions Used to Process 7 weight percent-NUCREL 599/NORPAR 15 Dispersions with the Niro-Soavi Panda Piston Homogenizer; Flow Rate = 160 mL/min.; Recycled Feeds

| Sample | Processing Vavle | Feed Temp. °F. | Process Pressure Bars/psi | Process Time Min | Resulting Ink Dispersion Comments | Horiba Particle Size Microns | Mavlern Particle Size Microns |
|---|---|---|---|---|---|---|---|
| control | shot mill | attrited | steam heat | 6 hrs | 2 hr heat grind, 4 hr ambient grind | 2.8 | 10.5 |
| One-step processing | | | | | | | |
| 1 | Ceramic Ball | 80 | 350/5,000 | 3 | very good | 2.12 | 5.32 |
| 2 | Ceramic Ball | 80 | 700/10,000 | 3 | good | 2.29 | 6.90 |
| 3 | Ceramic Ball | 96 | 1000/15,000 | 3 | aggregated particles, poor | — | — |
| 4 | Ceramic Ball | 110 | 1200/18,000 | 3 | aggregated particles, poor | — | — |
| Two-step processing | | | | | | | |
| 5 | Ceramic Ball | 200/3 min | 350/5,000 | 3 | poor | — | — |
| 6 | Ceramic Ball | 100/over 8 min | 350/5,000 | 10 | suspension failure, poor | — | — |
| 6 cont'd | Ceramic Ball | 96 | 350/5,000 | 20 | congealed, useable ink | 1.88 | 6.19 |
| 7 | Ceramic Ball | 190/6 min | 700/10,000 | 6 | congealed at 120° F. | — | — |
| 7 cont'd | Ceramic Ball | 124 | 700/10,000 | 13 | poor dispersion | — | — |
| 8 | Ceramic Ball | 118 | 700/10,000 | 20 | poor dispersion | — | — |
| One-step processing | | | | | | | |
| 9 | Emulsion | 74 | 350/5,000 | 5 | poor dispersion | 2.22 | 6.14 |
| 10 | Emulsion | 118–136 | 700/10,000 | 1 | chunks, poor | — | — |
| 11 | Emulsion | 124 | 700/10,000 | 1 | shear thickening product, poor | — | — |
| 12 | Emulsion | 138 | 1200/18,000 | 5 | shear thickening product, poor | — | — |
| 13 | Emulsion | 80 | 100/1,400 | 1 | good | 2.49 | 7.49 |
| 14 | Emulsion | 80 | 100/1,400 | 3 | good | 2.27 | 5.41 |
| 15 | Emulsion | 80–90 | 100/1,400 | 10 | very good | 2.05 | 4.97 |
| Two-step processing | | | | | | | |
| 16 | Emulsion | 70–130 | 100/1,400 | 10 | good | 2.32 | 7.50 |
| 17 | Emulsion | 80 | 100/1,400 | 30 | very good | 2.06 | 5.69 |
| 18 | Emulsion | 180 | 350/15,000 | 7 | collected hot, poor | — | — |
| 19 | Emulsion | 92 | 350/5,000 | 12 | good | 2.26 | 6.93 |
| 20 | Emulsion | 92 | 350/5,000 | 17 | very good | 2.07 | 5.94 |
| 21 | Emulsion | 80 | 500/7,100 | 7 | thick; 2 passes, poor | — | — |
| 22 | Emulsion | 80–118 | 500/7,100 | 10 | congealed; shear thickening | — | — |
| 22 cont'd | Emulsion | 118–120 | 500/7,100 | 15–30 | 22 cont'd, poor | — | — |
| 23 | Emulsion | 108–100 | 100/1,400 | 1 | redispersed; poor | — | — |

TABLE 2-continued

| Conditions Used to Process 7 weight percent-NUCREL 599/NORPAR 15 Dispersions with the Niro-Soavi Panda Piston Homogenizer; Flow Rate = 160 mL/min.; Recycled Feeds | | | | | | | |
|---|---|---|---|---|---|---|---|
| Sample | Processing Vavle | Feed Temp. °F. | Process Pressure Bars/psi | Process Time Min | Resulting Ink Dispersion Comments | Horiba Particle Size Microns | Mavlern Particle Size Microns |
| 24 | Emulsion | 90–100 | 100/1,400 | 15 | good | 2.58 | 6.65 |

What is claimed is:

1. A process for preparing a liquid or dry electrophotographic developer comprising:
   (a) forming a melt mixture comprised of a polymer resin or resins, a colorant, a charge director, and a nonaqueous solvent to obtain a first suspension of colored polymeric particles with a volume average diameter of from about 5 to about 100 microns; and
   (b) homogenizing with a dairy piston homogenizer said first suspension under pressure of from about 100 to about 500 Bars to obtain a second suspension containing colored polymeric particles with a volume average diameter of from about 0.1 to about 5 microns.

2. A process in accordance with claim 1 wherein the polymer resin is selected from the group consisting of polymers and copolymers prepared from monomer selected from the group of unsaturated monomers consisting of styrene and derivatives thereof, monocarboxylic acids and derivatives thereof; dicarboxylic acids and derivatives thereof; vinyl ketones; vinyl ethers; vinyl naphthalene; mono-olefins; diolefins; vinylidene halides; N-vinyl compounds; and mixtures thereof.

3. A process in accordance with claim 1 wherein the colorant is selected from the group consisting of cyan, yellow, magenta, red, green, blue, brown, orange and black pigments or dyes, and mixtures thereof.

4. A process in accordance with claim 1 wherein said charge director is selected from the group consisting of a fatty acid or fatty acid salt and mixtures thereof.

5. A process in accordance with claim 1 wherein the nonaqueous solvent is selected from the group consisting of linear and branched aliphatic hydrocarbons with from about 10 to about 25 carbon atoms and mixtures thereof.

6. A process according to claim 1 further comprising dispersing said melt mixture with high shear or ball milling, and or heating with agitation from about 25° C. to about 100° C., to obtain said first suspension.

7. A process according to claim 6 further comprising cooling said first suspension after heating to about 25° C.

8. A process according to claim 1 further comprising isolating from said second suspension the pigmented polymeric particles and optionally washing and drying.

9. A process according to claim 1 further comprising thermally cycling or shocking said first suspension at 25° C. by heating to 100° C. over a period of about 1 to about 10 minutes and then rapidly cooling to about 10° C. to about 25° C. just prior to said homogenization step.

10. A process in accordance with claim 1 wherein the first suspension is homogenized under a pressure of about 200 to about 350 Bars.

11. A process in accordance with claim 1 wherein the colored polymeric particles obtained have an area average particle diameter of from about 1.0 micron to about 2.5 microns.

12. A process in accordance with claim 1 wherein the pigmented polymeric particles obtained have a geometric particle size distribution (GSD) of from about 1.2 to about 1.5.

13. A process in accordance with claim 1 wherein the polymer resin has a number ($M_n$) and weight ($M_w$) average molecular weight between about 5,000 to about 500,000 and about 10,000 to about 2,000,000, 2,000,000, respectively.

14. A process in accordance with claim 1 wherein the number ($M_n$) and weight average molecular weight ($M_w$) of the polymer resin is between about 5,000 to about 50,000 and about 10,000 to about 100,000, respectively, and a polydispersity of between about 1 and about 15.

15. A liquid developer obtained by the process of claim 1 comprising a polymer resin or resins, a colorant, a charge director, and a nonaqueous solvent wherein the resulting colored polymeric particles have a volume average diameter of from about 1 to about 4 micrometers.

16. A liquid developer according to claim 15 wherein the polymeric resin or resins comprises from about 70 to about 98 percent by weight of the solids content of the developer, the colorant comprises from about 1 to about 30 percent by weight of the solids content of the developer, and the charge director comprises from about 1 to about 15 percent by weight of the solids content of the developer.

17. A liquid developer according to claim 15 wherein the nonaqueous solvent is present from about 50 to about 98 of the total weight of the developer.

18. A liquid developer according to claim 15 further comprising adding surface additives, charge directors or flow aids comprised of fine powders of conductive metal oxides, metal salts, metal salts of fatty acids, colloidal silicas, titanates, quaternary ammonium salts, metal complexes, organometallic complexes, or mixtures thereof, to the surfaces of the suspended finely divided colored polymeric particles.

19. A liquid developer according to claim 18 wherein the charge directors are selected from the group consisting of a mixture of a colloidal silica or titanate, and an organoaluminum, organoboron, organozinc, organochromium complex of a salicylic acid or catechol and said charge directors are added to the bulk of the polymer in said melt mixture.

20. A liquid developer according to claim 19 further comprising adding said charge director additives to the continuous nonaqueous solvent phase for regulating the charging properties of the dispersed colored polymeric particles.

21. A liquid developer according to claim 20 wherein the charge director compounds are comprised of quarternary ammonium salts, conductive metal oxides, metal and organometallic salts.

22. A developer according to claim 21 further comprising removing the nonaqueous solvent to afford a dry free flowing powder suitable for use as a dry developer.

* * * * *